US010349469B2

(12) United States Patent
Khokle et al.

(10) Patent No.: US 10,349,469 B2
(45) Date of Patent: Jul. 9, 2019

(54) INDUCTION COOKING APPLIANCE AND METHOD FOR ITS ASSEMBLY

(71) Applicant: WHIRLPOOL CORPORATION, Benton Harbor, MI (US)

(72) Inventors: Himanshu Khokle, Nagpur (IN); Luca Leonardi, Oleggio (IT); Pradeep Thorat, Miraj (IN)

(73) Assignee: Whirlpool Corporation, Benton Harbor, MI (US)

( * ) Notice: Subject to any disclaimer, the term of this patent is extended or adjusted under 35 U.S.C. 154(b) by 473 days.

(21) Appl. No.: 15/085,529

(22) Filed: Mar. 30, 2016

(65) Prior Publication Data

US 2016/0295644 A1 Oct. 6, 2016

(30) Foreign Application Priority Data

Mar. 30, 2015 (EP) ..... 15161797

(51) Int. Cl.

| | |
|---|---|
| ***H05B 6/04*** | (2006.01) |
| ***H05B 6/12*** | (2006.01) |
| ***H05B 6/36*** | (2006.01) |
| ***F24C 15/10*** | (2006.01) |

(52) U.S. Cl.

CPC ..... *H05B 6/04* (2013.01); *F24C 15/101* (2013.01); *F24C 15/104* (2013.01); *H05B 6/12* (2013.01); *H05B 6/1263* (2013.01); *H05B 6/36* (2013.01); *H05B 2206/022* (2013.01)

(58) Field of Classification Search

CPC ... H05B 6/04; H05B 6/12; H05B 6/36; H05B 6/1263

USPC ..... 99/325, 348; 219/385, 600, 626, 632

See application file for complete search history.

(56) References Cited

U.S. PATENT DOCUMENTS

| | | | | |
|---|---|---|---|---|
| 2003/0183617 | A1* | 10/2003 | Platt | H05B 3/68 219/452.11 |
| 2008/0142512 | A1* | 6/2008 | Kim | F24C 15/101 219/757 |
| 2013/0126519 | A1 | 5/2013 | Arnal Valero et al. | |

FOREIGN PATENT DOCUMENTS

| | | | | |
|---|---|---|---|---|
| DE | 102007032762 | A1 * | 2/2008 | H05B 3/74 |
| DE | 102009000837 | A1 * | 8/2009 | H05K 7/1417 |
| EP | 2079275 | A1 * | 7/2009 | F24C 7/06 |
| EP | 2256416 | A2 * | 12/2010 | F24C 7/082 |
| EP | 2595450 | A2 | 5/2013 | |
| EP | 2703724 | A1 | 3/2014 | |
| GB | 2100853 | A | 1/1983 | |

OTHER PUBLICATIONS

European Patent Office, "Patent European Search Report," dated Jul. 29, 2015 (6 pages).

* cited by examiner

*Primary Examiner* — Thien S Tran
(74) *Attorney, Agent, or Firm* — Price Heneveld LLP

(57) ABSTRACT

An induction cooking appliance comprises a bottom metal tray containing a printed circuit board and electronic components mounted thereon, and also a pair of polymeric support elements configured to be fastened to the metal tray and interposed between the tray and the printed circuit board in order to define a predetermined distance between the tray and the printed circuit board. The polymeric support elements may have an integral intermediate polymeric frame which provides a predetermined relative position thereof.

19 Claims, 8 Drawing Sheets

INDUCTION COOKING APPLIANCE AND METHOD FOR ITS ASSEMBLY

TECHNICAL FIELD

The present disclosure relates to induction cooking appliances comprising a bottom metal tray containing a printed circuit board and electronic components mounted thereon.

BACKGROUND OF THE DISCLOSURE

According to the disclosure, a way of quickly mounting the printed circuit board on the metal tray without insulation problems is provided. Moreover the technical solution according to the disclosure has a low cost, simple to assemble and easy for packaging.

BRIEF DESCRIPTION OF THE DRAWINGS

Further advantages and features according to the present disclosure will become clear from the following detailed description provided as a non-limiting example, with reference to the attached drawings in which.

DESCRIPTION OF THE EMBODIMENTS

Figure 1:
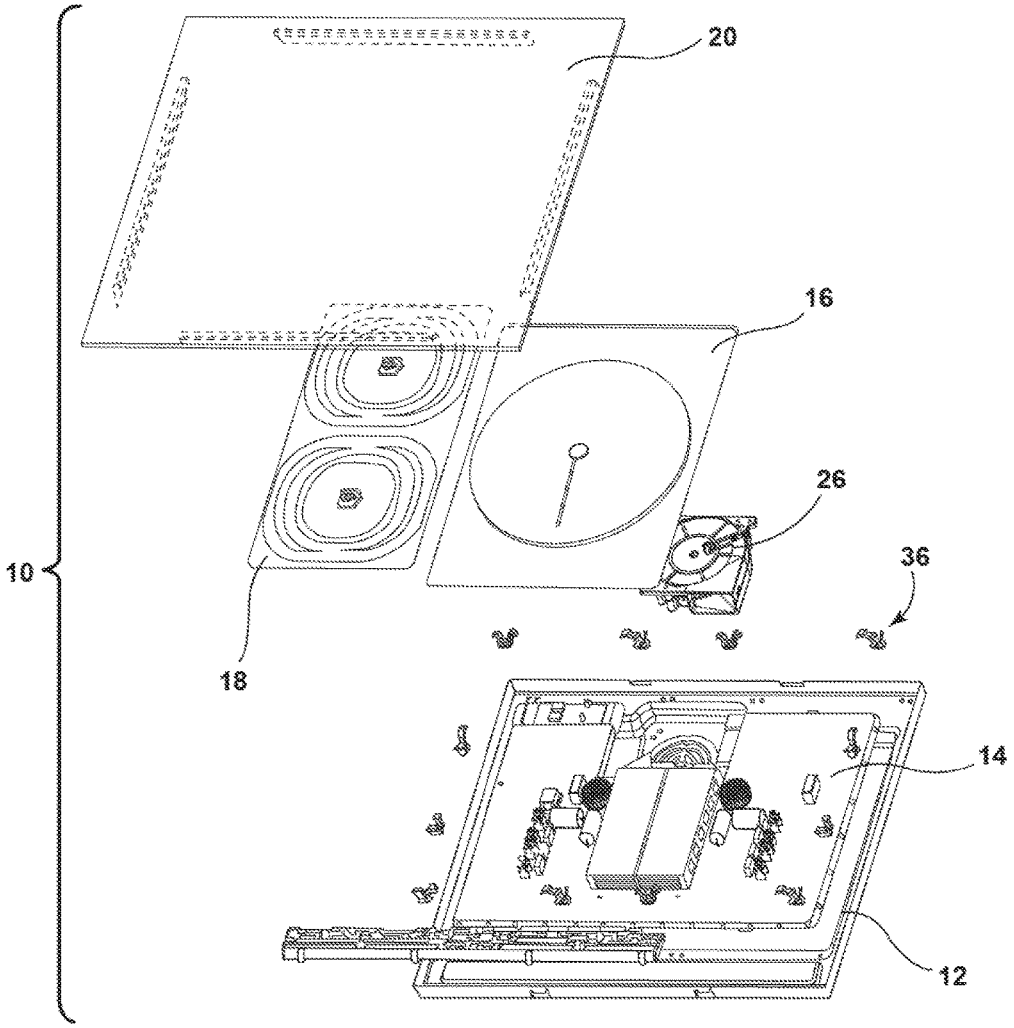
FIG. 1 is a perspective exploded view of an induction cooking hob according to the disclosure.

The present illustrated embodiments reside primarily in combinations of method steps and apparatus components related to a display mirror. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer of the display mirror, and the term "rear" shall refer to the surface of the element further from the intended viewer of the display mirror. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to the drawings, an induction cooking hob 10 according to the disclosure comprises a metal tray or box 12, a main printed circuit board or PCB 14, induction coil trays 16 and 18 and a top glass plate 20. A plurality of electronic components 22 are mounted. Moreover, on the PCB 14 a heat sink 24 is mounted, which is cooled by a fan 26 mounted on the metal tray 12 adjacent an aperture 12*a* thereof. The heat sink 24, used to cool down some of the electronic components 22 which generate more heat, can be mounted on a polymeric support element together with the fan 26 and with the electronic components 22. The polymeric support element is contained in the metal tray 12.

Figure 2:
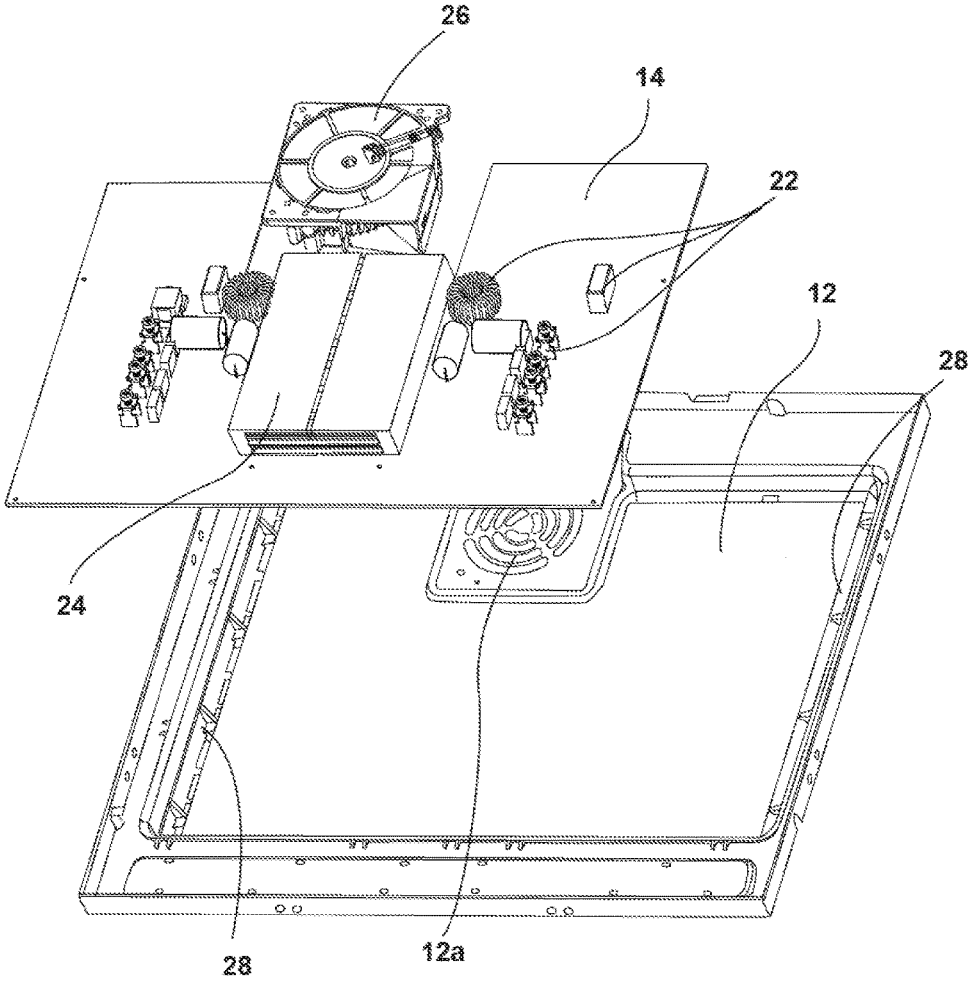
FIG. 2 is an enlarged exploded view of the appliance of FIG. 1 according to a first embodiment of the disclosure, where some components have been omitted for sake of clarity.
Figure 3:
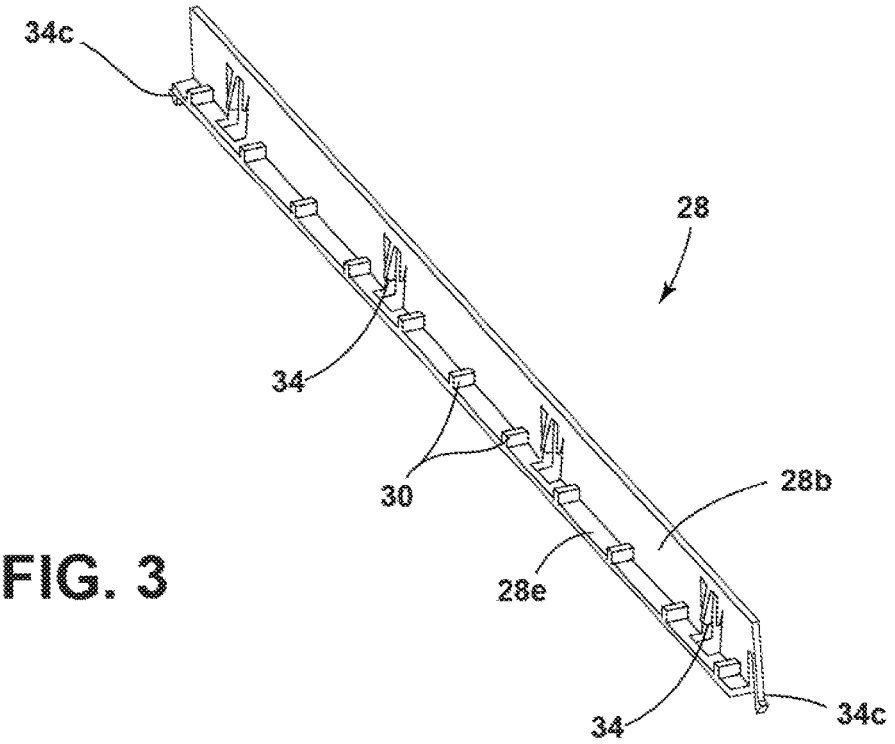
FIG. 3 is a perspective enlarged view of a component of FIG. 2.
Figure 4:
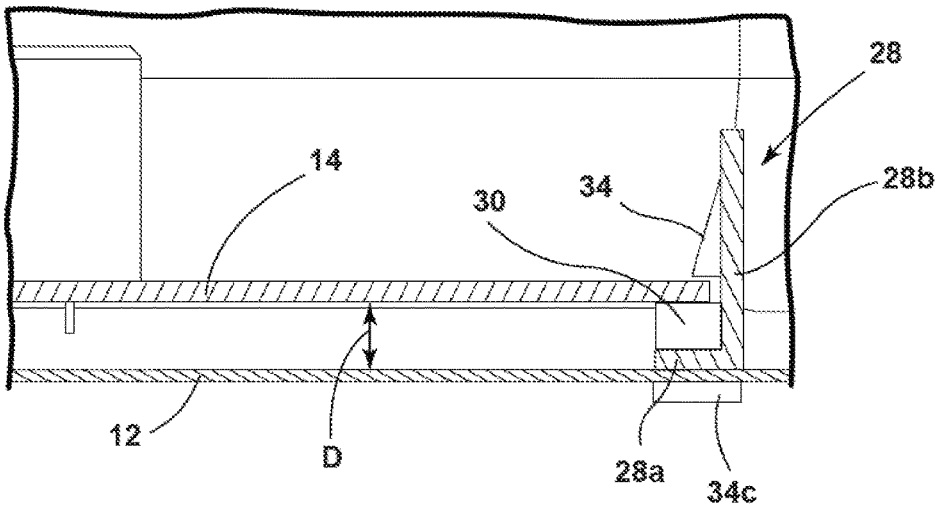
FIG. 4 is a cross-section of a portion of the appliance of FIG. 2, in an assembled configuration.

With reference to FIG. 2, two support elements 28 made of polymeric material are mounted on the metal tray 12. Each support element 28 is an elongated profile and has an L-shaped cross-section defining a first wing 28*a* configured to contact the top surface of the metal tray in an assembled position thereof, and a second wing 28*b* which is vertical in the assembled configuration. As shown in FIGS. 3 and 4, the first wing 28*a* of each support element 28 is provided with a plurality of ribs 30 while the second wing 28*b* is provided with a plurality of shaped teeth adapted to cooperate with the PCB 14 after a snap-engagement thereof on the ribs 30, as shown in FIG. 4. Each of the support elements 28 is provided, at distal ends thereof, with an elastic hook portion 34 designed to cooperate, in a snap-engaging assembling movement, with corresponding slots in the metal tray. In this way, the two support elements 28 can be easily and rapidly mounted in the metal tray 12, without any use of tools or the like, so that such elements 28 assume the configuration shown in FIG. 2. After that, the next assembly step is to snap-engage parallel edges 14*a* of the PCB 14 on the support elements 28 so that the rear surface of the PCB 14 abuts the ribs 30 of the first wings 28*a* while the upper surface of the PCB 14 is retained by the elastic hook portions 34 of the second wings 28*b*. The dimension of the ribs 30 defines, together with the thickness of the first wing 28*a*, a predetermined distance D of the PCB 14 from the metal tray 12.

Figure 11:
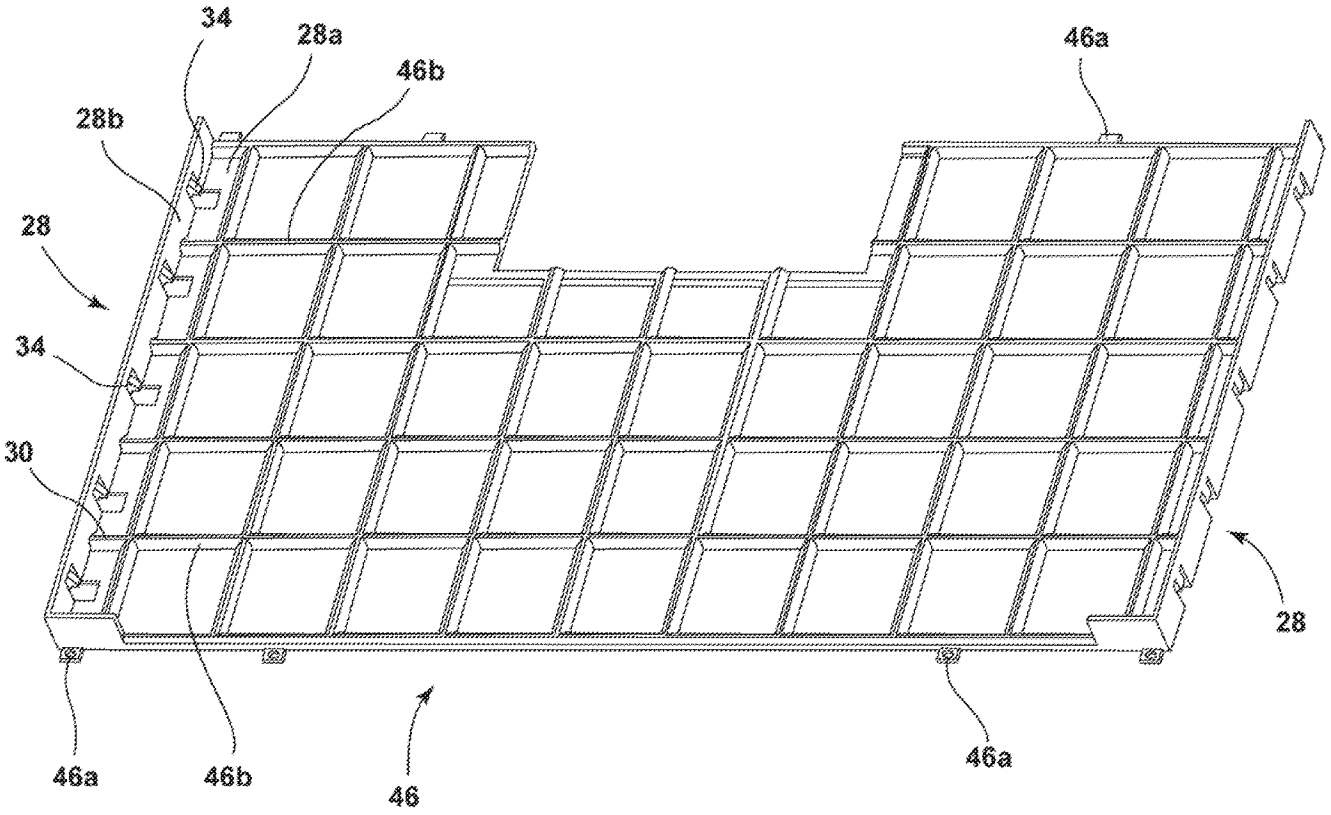
FIG. 11 is a perspective view of a different embodiment of the component shown in FIG. 3.

In FIG. 11, a different embodiment of the support elements 28 is shown. The support elements 28 are integral with an intermediate flat frame 46 with a grating structure and with portions 46*a* for fixing such frame 46 to the metal tray, for instance with screws, rivets or the like. In such embodiment, the ribs 30 are integral with the web portions 46*b* of the frame 46. The use of the intermediate flat frame 46 may be beneficial in reducing possible deformation of the PCB 14 and possible stresses in the welding.

Figure 8:
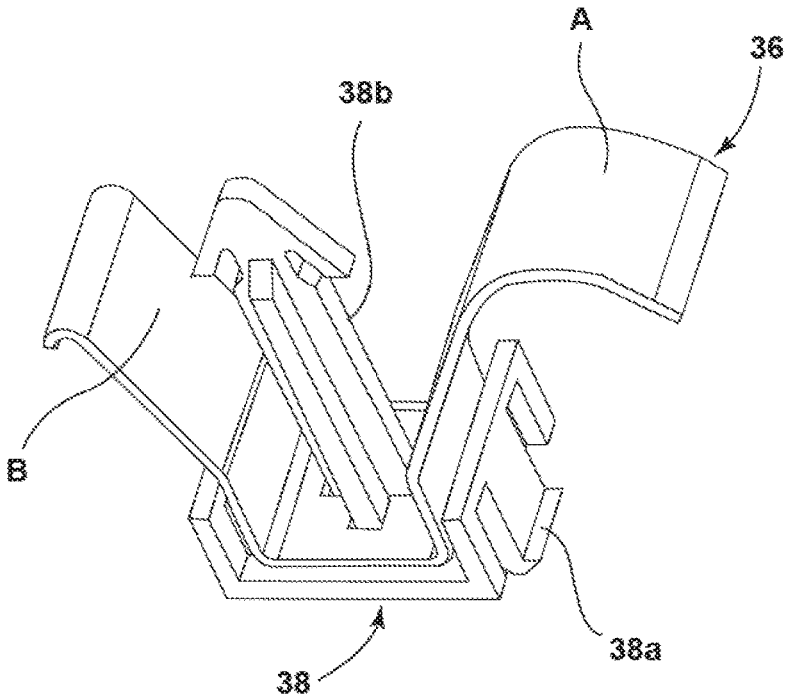
FIG. 8 is a perspective enlarged view of an elastic fastening component of the coil support according to the disclosure.
Figure 9:
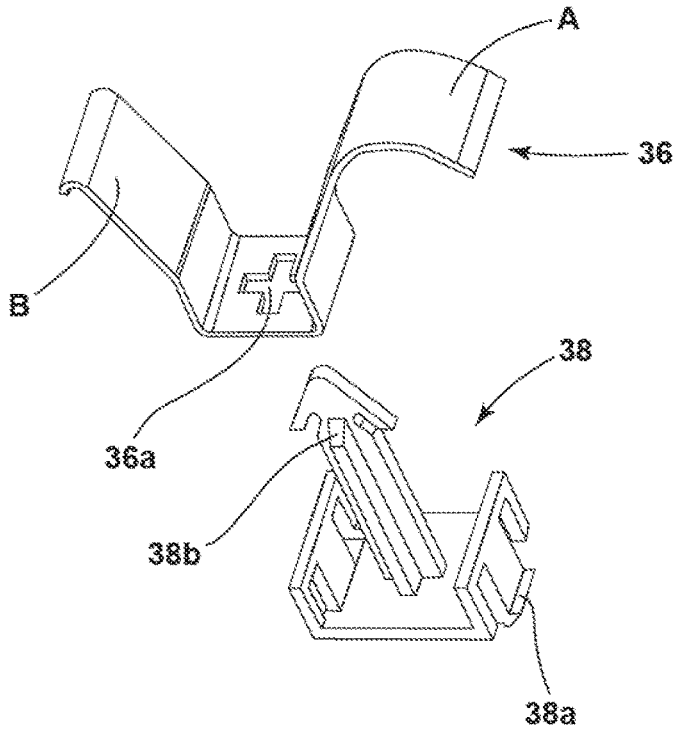
FIG. 9 is similar to FIG. 8 where such fastening component is shown is an disassembled configuration.
Figure 10:
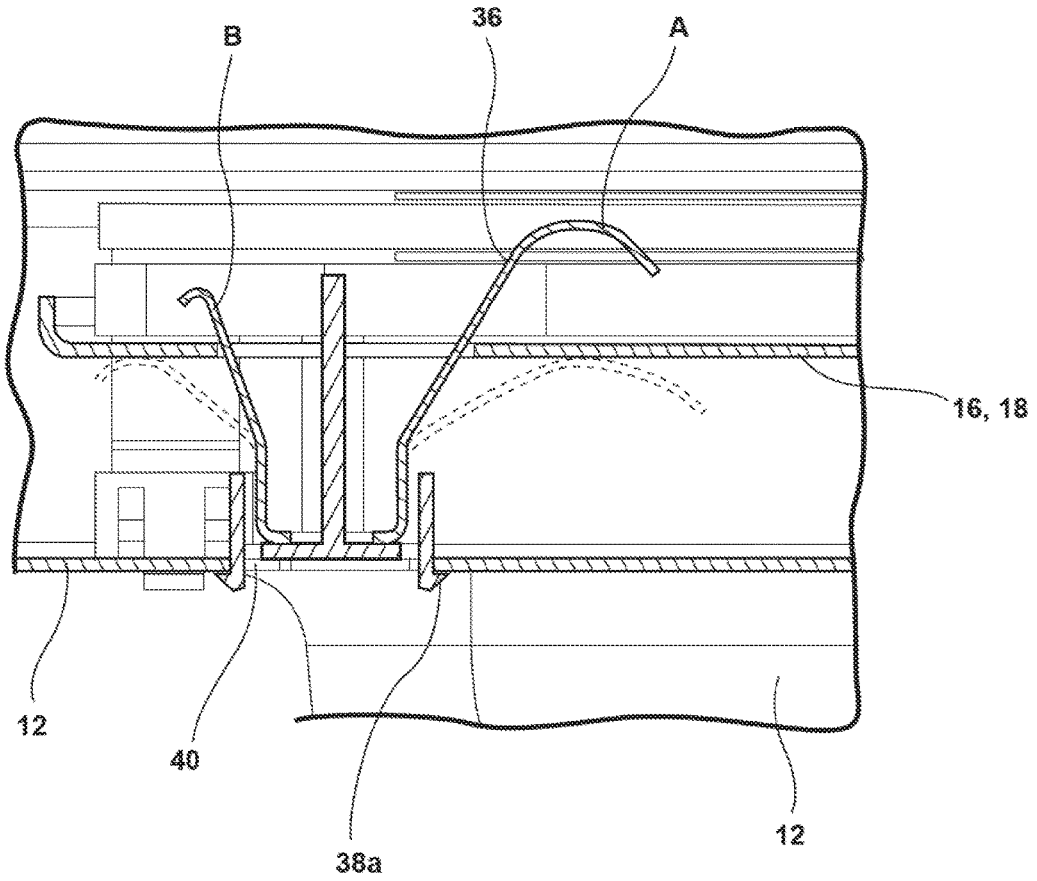
FIG. 10 is a cross-section view of a portion of the cooking hob of FIG. 1 which shows the fastening component of FIGS. 8 and 9 in an assembled configuration of the cooking hob.

With reference now to FIG. 8, the assembly of the coil trays 16 and 18 on the elastic clips 36 is illustrated. The elastic clips 36 are located in plastic standoffs 38 with central pins 38*a* snap-engaged in corresponding slots 50 (FIG. 10) of the metal tray 12. The shape of each plastic standoff 38 provides for a proper orientation of the elastic clip 36 itself. The central pin 38*b* whose cross-section matches the shape of a central bore 36*a* in the clip 36 can freely slide in a corresponding opening of the coil trays 16 and 18 to provide the proper orientation. The clip 36 generally defines a spring and has two elastic shaped arms A and B, a first curved arm A designed to exert a main elastic force on the coil tray 16 or 18 (configuration shown in dotted lines in FIG. 10), and a second smaller arm B exerting a reduced force on a peripheral zone of the coil tray 16 or 18. In this way, there is a smaller deflection of the coil tray 16 or 18 since the major force exerted by the clip 36 is displaced towards the center of the coil tray 16 or 18.

As described above, the mounting of the PCB 14 on the support elements 28 and the mounting of the coil trays on the elastic clips 36 and on the central pins 38*a* do not require any special tools and can be carried out easily and quickly.

The assembly of the coil trays 16 and 18 as shown in the above example includes the use of elastic clips 36. However, the trays 16 and 18 can also be supported directly by the metal tray 12 without the interposition of any elastic clips 36. In this case the correct positioning of such tray is provided by bent portions of the bottom of the metal tray 12 which are tongue shaped and substantially orthogonal with the plane defined by the metal tray 12.

Figure 5:
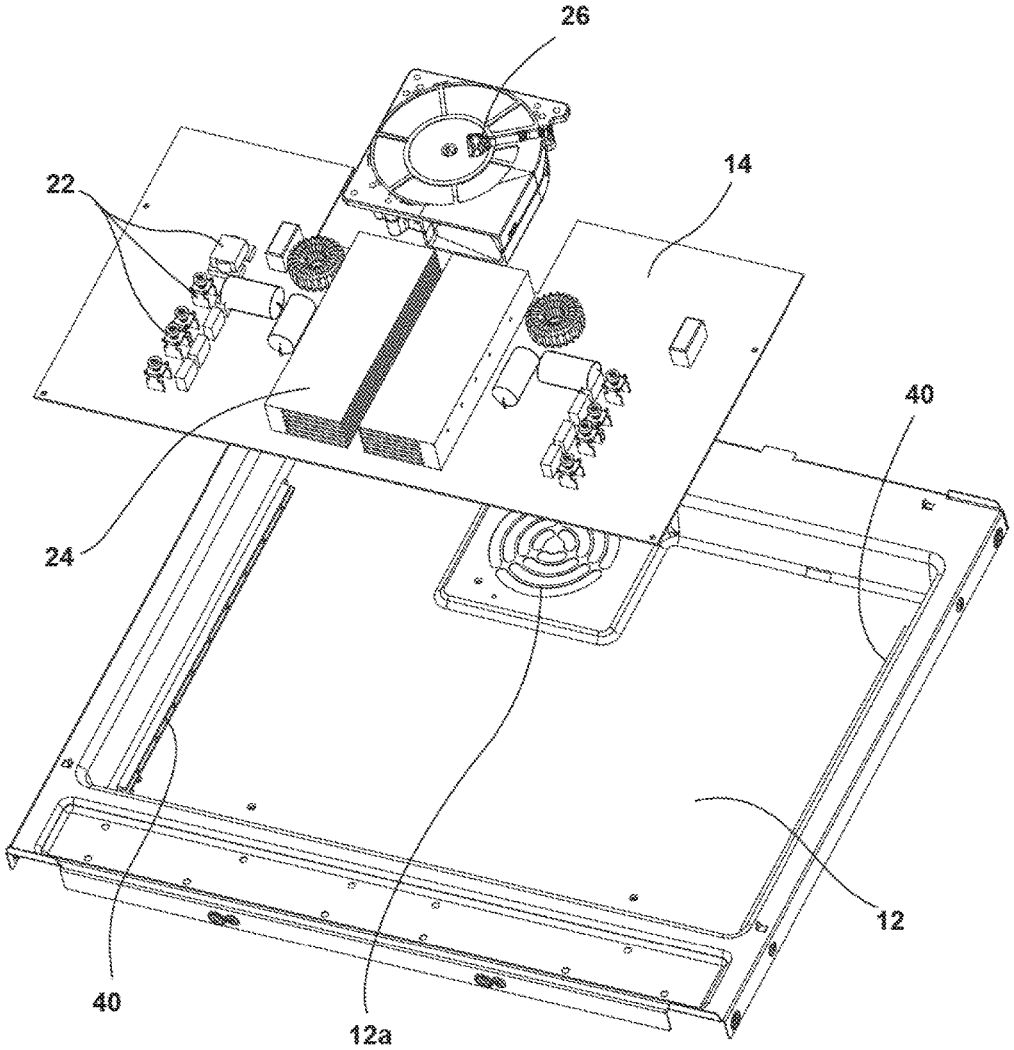
FIG. 5 is an enlarged exploded view of the appliance of FIG. 1 according to a second embodiment of the disclosure, where some components have been omitted for sake of clarity.
Figure 6:
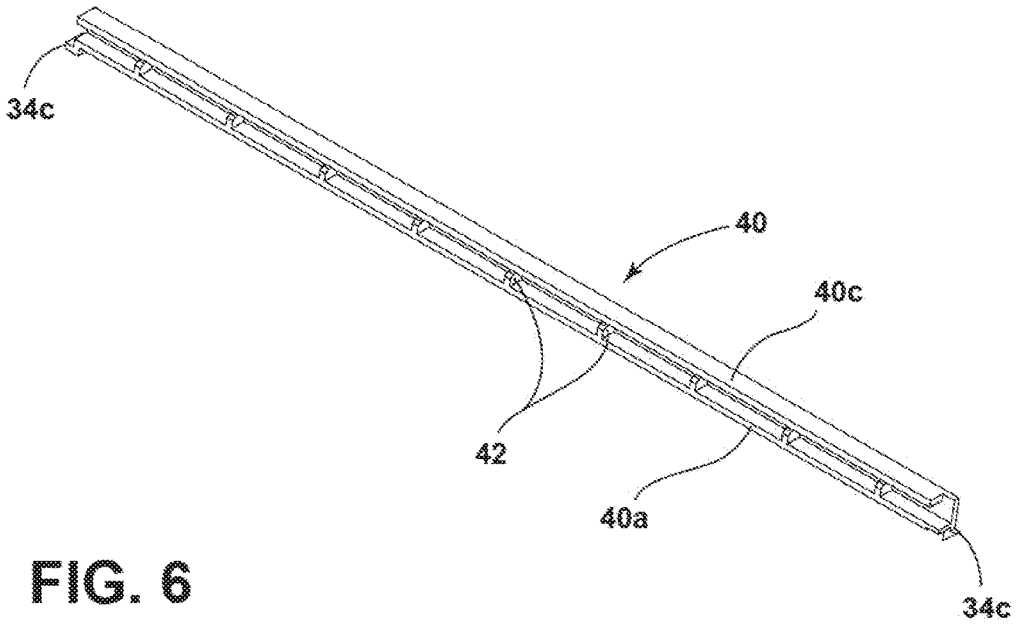
FIG. 6 is a perspective enlarged view of a component of FIG. 5.
Figure 7:
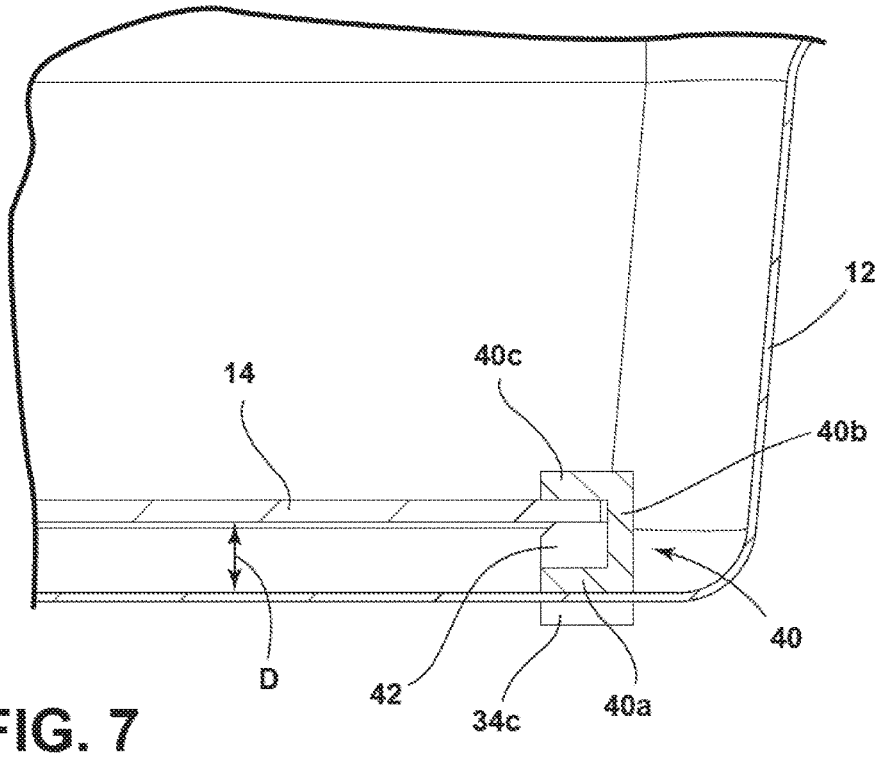
FIG. 7 is a cross-section of a portion of the appliance of FIG. 5, in an assembled configuration.

With reference to FIGS. 5-7, a second embodiment of the disclosure is shown which is different from the previous one in the shape of support elements 40. While the fastening of each support element 40 to the metal tray 12 is substantially identical to the previous one, i.e. with elastic hook portions 34*c* provided on distal ends, each support element 40 has a C-shaped cross-section with a first part 40*a* configured to contact the upper surface of the metal tray 12, a second vertical part 40*b* (in the installed configuration) and a third horizontal part 40*b*. As shown in FIGS. 6 and 7, a plurality of ribs 42 are placed on the first and second part 40*a* and 40*b*. The plurality of ribs 42 (integral with such parts) present an upper surface 42*b* at a predetermined distance from the third part 40*c* of the support element 40, such distance corresponding to the thickness of the PCB 14 inserted between such ribs 42 and the third part 40*c* of the support element 40. The vertical dimension of the ribs 42 assure (as in the first embodiment) a sufficient distance of the PCB 14 from the metal tray 12 in order to have a proper electrical insulation, with no accidental contacts. For installing the PCB 14 in the support elements 40 it is sufficient to slightly flex the PCB 14 and to insert two parallel edges thereof in the slots defined by the ribs 42 and by the upper third part 40*c* of each support elements 40. The mounting of the support elements 40 and of the coil trays 16 and 18 is substantially identical to what already described in connection with the first embodiment. Also in this embodiment the support elements 40 can be integral with an intermediate frame 46 as shown in FIG. 11.

The material of the polymeric support elements 28 and 40 can be chosen in a wide range of thermoplastic or thermosetting materials. In order to have a sufficient rigidity of such supports, it is desirable to use a polymeric material (polypropylene, polyamide etc.) with a fiber reinforce (for instance glass fibers).

Moreover, the two different kind of support elements 28 and 40 may be combined together in the same cooking hob, particularly in view of making easier the mounting of the PCB 14 on such supports; in this case one edge of the PCB 14 may be installed in the slot of the support element 40 and the other opposite edge is lowered on the opposite support element 28 and snap-engaged on the elastic hook portions 34*c*.

Even though in the above examples a single large printed circuit board 14 is shown, a plurality of smaller printed circuit board can also be used, each of them having two support elements 28 snap-engaged with the metal tray 12.

It is clear from the above that each embodiment of the disclosure has the advantage of a very quick and easy mounting of relevant components (printed circuit board and coil trays) onto the metal tray which encompasses all such components, without any need of special tool. Such way of assembling the induction cooking hob can be easily automated and offers a high degree of reliability in assembling operation, which increases the quality of the appliance.

It is well known in the art of induction cooking appliances, particularly of cooking hobs, that essential components are a housing containing the electronic components and a cooling fan, on which supporting plates for induction coils are mounted and on which a glass plate, on which cooking utensil are to be placed, is mounted too. The ways in which such different components can be assembled one with the other can vary quite widely, but the most common technology is to fasten the glass plate to the bottom metal tray after mounting the printed circuit board therein and placing the induction coils on supporting plates which are supported by the tray, with the interposition of elastic elements which urge the induction coils against the glass plate.

Even if for the bottom tray plastic have been used as construction material, the use of metal tray has certain technical advantages, either in terms of low cost or shielding effect from electromagnetic radiations emerging from the power electronic components. On the other hand, the use of a metal tray or plate may present the problem of installation of electrical insulation.

It is an object of the present disclosure to provide an induction cooking appliance with solves the above problem in a simple and economical way. Such object is reached thanks to the features listed in the appended claims.

It will be appreciated that embodiments of the disclosure described herein may be comprised of one or more conventional processors and unique stored program instructions that control one or more processors to implement, in conjunction with certain non-processor circuits, some, most, or all of the functions of an induction cooking hob 10, as described herein. The non-processor circuits may include, but are not limited to signal drivers, clock circuits, power source circuits, and/or user input devices. As such, these functions may be interpreted as steps of a method used in using or constructing a classification system. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, the methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An induction cooking appliance comprising:

a bottom metal tray including a printed circuit board and electronic components mounted thereon, the metal tray comprising at least a pair of polymeric support elements configured to be fastened to the metal tray and interposed between the metal tray and the printed circuit board in order to define a predetermined distance between the metal tray and the printed circuit board, each of the polymeric support elements having an elongated profile configured to snap-engage with corresponding apertures in the metal tray and having a continuous L-shaped cross-section across most of the polymeric support element, comprising:

a first portion disposed in a horizontal position when the elongated profile is mounted on the metal tray, and which presents a plurality of ribs defining said predetermined distance; and a second portion disposed in a vertical position when the elongated profile is mounted on the metal tray, and having snap engaging elements for retaining the printed circuit board on the elongated profile.

2. The induction cooking appliance according to claim 1, wherein the polymeric support elements are integral with an intermediate frame.

3. The induction cooking appliance according to claim 1, further comprising:

coil supports disposed above the printed circuit board and a plurality of support devices mounted on the metal tray and configured to be inserted in corresponding seats of the coil supports.

4. The induction cooking appliance according to claim 3, wherein springs are mounted between the plurality of support devices and the coil supports, the springs configured to urge coils against an upper glass plate.

5. The induction cooking appliance according to claim 3, wherein each of the plurality of support devices comprises a polymeric base element with hook portions configured to snap-engage with corresponding slots in the metal tray for a quick mounting thereof.

6. The induction cooking appliance according to claim 5, wherein the polymeric base element includes a central post with a cross-section matching a corresponding hole of each spring so each such spring is easily located in a predetermined position on the polymeric base element.

7. The induction cooking appliance according to claim 3, wherein the polymeric support elements are formed from a polymeric material with fiber reinforcement.

8. The induction cooking appliance according to claim 3, wherein a leaf spring has two ends having a different shape and exerting a different elastic force on a coil tray, a highest force being exerted at a position closer to a center of the coil tray.

9. An induction cooking appliance comprising:

a bottom metal tray including a printed circuit board and electronic components mounted thereon, the metal tray comprising at least a pair of polymeric support elements, each of the polymeric support elements having:

a first portion oriented substantially perpendicular to a second portion; and a plurality of ribs linearly aligned and interspaced on the first portion, the plurality of ribs operably coupled to the first portion and the second portion;

wherein each polymeric element is configured to be fastened to the metal tray and interposed between the metal tray and the printed circuit board in order to define a predetermined distance between the metal tray and the printed circuit board.

10. The induction cooking appliance according to claim 9, wherein each of the polymeric support elements includes an elongated profile configured to snap-engage with corresponding apertures in the metal tray.

11. The induction cooking appliance according to claim 9, wherein the polymeric support elements are integral with an intermediate frame.

12. The induction cooking appliance according to claim 10, wherein the elongated profile has an L-shaped cross-section, wherein the first portion is configured to be in a horizontal position when the elongated profile is mounted on the metal tray, and further wherein the second portion is configured to be in a vertical position when the elongated profile is mounted on the metal tray, each polymeric support element including snap engaging elements for retaining the printed circuit board on the elongated profile.

13. The induction cooking appliance according to claim 10, wherein the elongated profile has a C-shaped cross-section configured to house an edge of the printed circuit board.

14. The induction cooking appliance according to claim 13, wherein the C-shaped cross-section of the elongated profile includes the first portion as a lower portion configured to be in a horizontal position when the elongated profile is mounted on the metal tray with an upper portion parallel to the first portion, the elongated profile further including the plurality of ribs having ends at the predetermined distance from the upper portion in order to define a seat for the edge of the printed circuit board.

15. The induction cooking appliance according to claim 14, further comprising:

coil supports above the printed circuit board and a plurality of support devices mounted on the metal tray and configured to be inserted in the corresponding seats of the coil supports, springs being mounted between such support devices and the coil supports in order to urge coils against an upper glass plate, wherein said support devices comprise a polymeric base element with hook portions configured to snap-engage with corresponding slots in the metal tray for a quick mounting thereof, such polymeric base element having a central post with a cross-section matching a corresponding hole of each of the springs so that each of the springs can be easily located in a predetermined position onto the polymeric base element.

16. The induction cooking appliance according to claim 15, wherein each of the springs has two ends having a different shape and exerting a different elastic force on a coil tray, a highest force being exerted at a position closer to a center of the coil tray.

17. A method for assembling an induction cooking appliance comprising:

forming a bottom metal tray containing a printed circuit board with electronic components;

orienting at least a pair of parallel polymeric support elements relative to the bottom metal tray with a first portion of each polymeric support element parallel to the bottom metal tray and a second portion of each polymeric support element perpendicular to the bottom metal tray;

snap engaging each of the polymeric support elements on the metal tray by inserting a single-armed hook portion positioned on a distal end of each of the polymeric support elements into a respective slot defined by the metal tray until a foot extending perpendicular to the first and second portions of the respective polymeric support element abuts a bottom surface of the metal tray; and installing edges of the printed circuit board on such polymeric support elements in order to have a predetermined distance between the metal tray and the printed circuit board.

18. The method according to claim 17, further comprising:

snap engaging the printed circuit board onto the polymeric support elements.

19. The method according to claim 17, further comprising:

mounting coil trays on the metal tray by means of support devices comprising a polymeric base element with hook portions which are snap-engaged with corresponding slots in the metal tray, such polymeric base element having a central post with a cross-section matching a corresponding hole of a leaf spring configured to cooperate with the coil trays in order to urge them towards an upper glass plate so that such leaf spring can be easily located in a predetermined position onto the polymeric base element.

* * * * *